United States Patent [19]

Herbert

[11] Patent Number: 4,973,931

[45] Date of Patent: Nov. 27, 1990

[54] TRIPPING DEVICE FOR CIRCUIT BREAKERS

[75] Inventor: Wirth Herbert, Gisikon, Switzerland

[73] Assignee: Weber AG, Switzerland

[21] Appl. No.: 364,446

[22] PCT Filed: Sep. 20, 1988

[86] PCT No.: PCT/CH88/00166

§ 371 Date: May 2, 1989

§ 102(e) Date: May 2, 1989

[87] PCT Pub. No.: WO89/03116

PCT Pub. Date: Apr. 6, 1989

[30] Foreign Application Priority Data

Sep. 29, 1987 [CH] Switzerland ..... 3721/87

[51] Int. Cl.[5] ..... H01H 61/06; H01H 71/18

[52] U.S. Cl. ..... 337/139; 337/140

[58] Field of Search ..... 337/139, 140, 393; 335/141, 142, 143

[56] References Cited

U.S. PATENT DOCUMENTS 4,205,293 5/1980 Melton ..... 337/139

4,263,573 4/1981 Melton ..... 337/140

4,713,643 12/1987 Baum et al. ..... 337/140

FOREIGN PATENT DOCUMENTS 0145204 6/1985 European Pat. Off. .

383105 10/1923 Fed. Rep. of Germany .

17519 3/1908 Norway .

*Primary Examiner*—H. Broome

*Attorney, Agent, or Firm*—Tarolli, Sundheim & Covell

[57] ABSTRACT

A tripping device (1) for circuit breakers comprising a thermally influenceable wire-shaped tripping element (4) is presented, one end of which is attached to a rotatably supported tripping lever (3) which is under spring force and the other end of which is fixed in location. The thermally influenced lateral movement at one end of the tripping element (4) causes the unlatching of the circuit breaker. At the free end of the tripping lever (3), a locking element (11) is provided which engages a cam (10) of a contact lever (2) which is under spring force, in such a manner that the circuit breaker is switched off both with contraction and with expansion of the tripping element (4).

9 Claims, 2 Drawing Sheets

TRIPPING DEVICE FOR CIRCUIT BREAKERS

Figure 1:
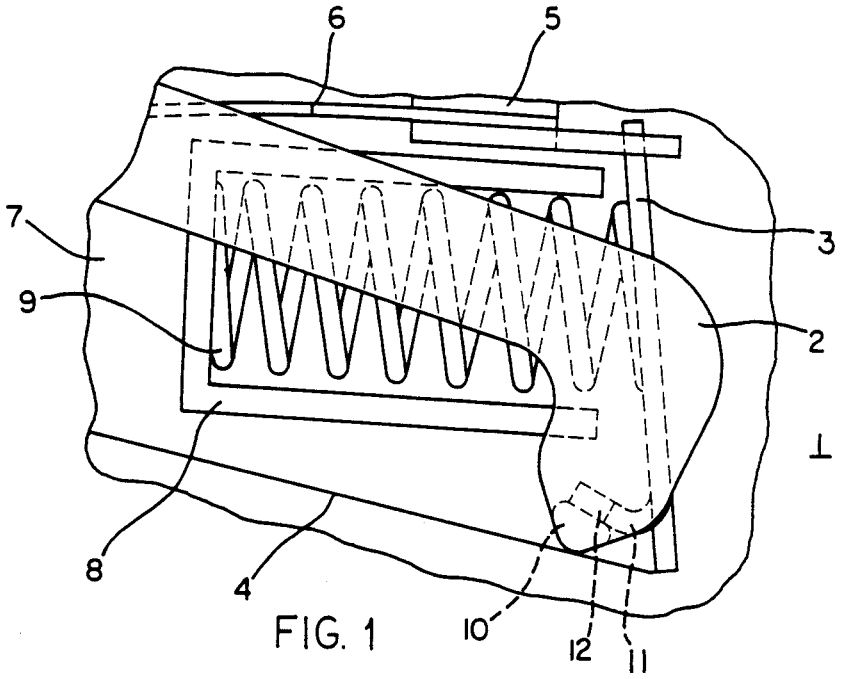

The invention relates to a tripping device for circuit breakers according to the precharacterizing clause of Claim 1. Such a tripping device is known, for example, from CH-A-616270. In this document, a thermoelectric switch comprising a tripping element of a memory alloy with two-way effect is known. The switch possesses at least one clamping device which acts in conjunction with the tripping element and the force of which, which acts on the tripping element, is used for defining the temperature of the switching process. In this arrangement, the tripping element has the dual function of slow- and of fast-acting tripping elements. In a special embodiment, the tripping element is a wire of memory alloy. The actual contact of the switch is operated via a complicated switching mechanism comprising several tension and compression springs.

The invention is then based on the object of creating a tripping device for circuit breakers of the type mentioned above, in which arrangement the switching mechanism is particularly simple and the tripping element can be both a wire of a memory alloy and a wire of a thermally expanding metal. It should also be unimportant whether a memory alloy according to the one-way or two-way effect is used.

In a tripping device of the abovementioned type, this object is achieved by the features of Claim 1. The tripping device according to the invention has the great advantage that the tripping mechanism is designed to be particularly simple and enables both tripping with contraction and with expansion of the wire-shaped tripping element. In a particular embodiment according to Claim 2, a compression spring is arranged between the tripping lever and a housing rib. As a result, the wire-shaped tripping element is always stretched. If a thermally expanding wire is used according to Claim 3, a precisely determined thermally dependent length is given due to the reversible and reproducible thermal effect of the wire. The temperature-dependent length is also always known if a memory alloy—particularly with two-way effect—according to Claim 4 is used. If, in the above cases, the wire breaks due to careless handling, the circuit breaker is also tripped. If wires of memory alloy according to the one-way effect are used as tripping element and if it is required that the circuit breaker should switch on again after a fault, a stop is required in the housing. Nevertheless, in order to ensure tripping in the case of a wire break, the intermediate lever with additional compression spring according to Claim 5 or the transmission element according to one of Claims 6, 7 or 8 are provided.

Figure 2:
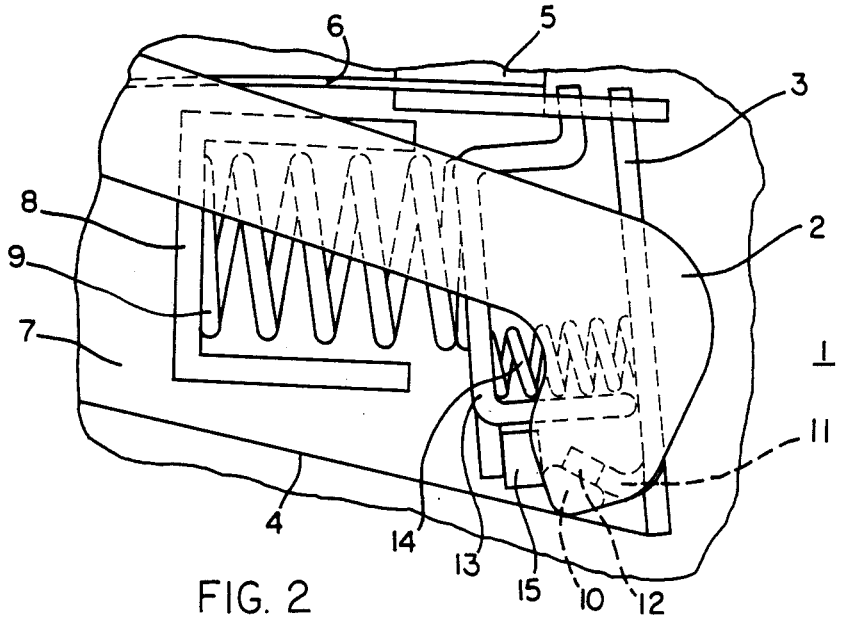
Figure 3:
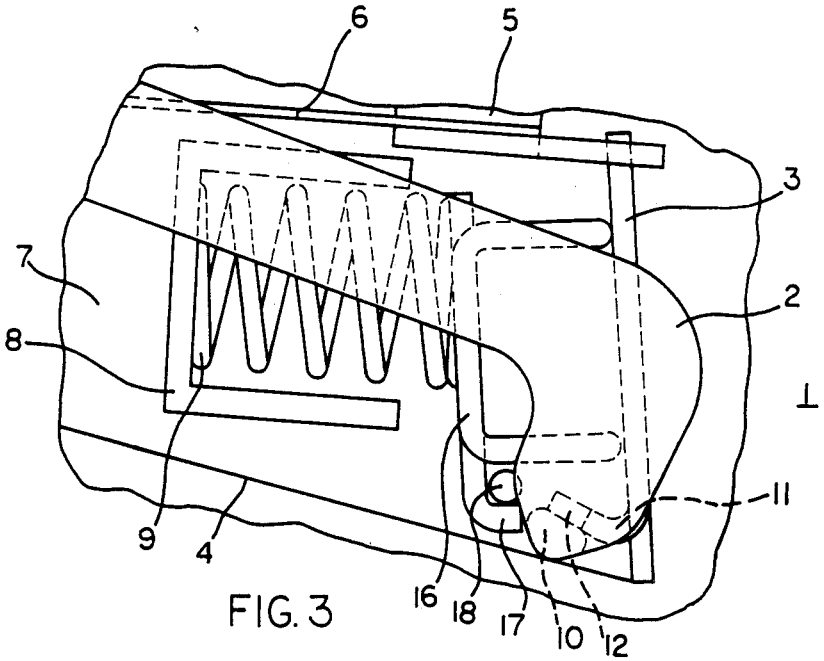
Figure 4:
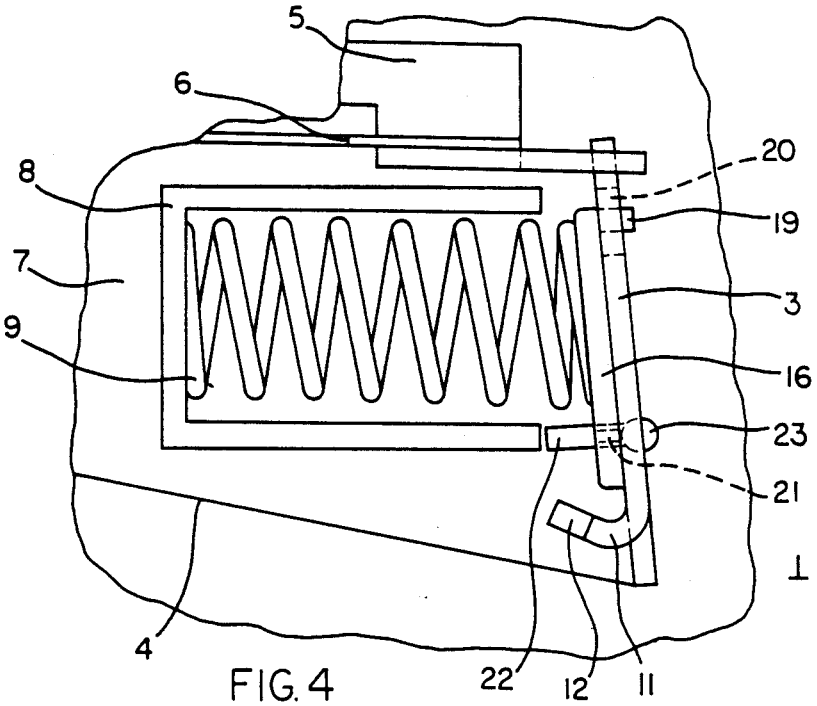

Further advantages of the invention are obtained from the description following. In this description, the invention is explained in greater detail with reference to an illustrative embodiment shown in the drawing, in which:

FIG. 1 shows a particularly simple embodiment of a tripping device for circuit breakers, FIG. 2 shows a tripping device with intermediate lever and additional compression spring, FIG. 3 shows a tripping device comprising a first variant of a transmission element, and FIG. 4 shows a tripping device comprising a second variant of a transmission element.

The same reference numbers are used for the same elements in the figures.

In FIG. 1, the tripping device 1 of a circuit breaker is shown in section. The structure of such a circuit breaker is known per se and can be seen, for example, in Swiss Patent Application No. 03 147/87-0. The tripping device 1 consists of a contact lever 2, a spring-loaded tripping lever 3 and a wire-shaped tripping element 4. The tripping element 4 is fixed in location with its end (not shown) and attached to the tripping lever 3 with its other end. The tripping lever 3 is rotatably supported on a linking piece (only partly visible). A leaf spring 6 is permanently joined to the linking piece 5 and forms the actual contact of the circuit breaker with its other end. In the housing wall 7 of the circuit breaker, a housing rib 8 in the form of an open rectangle (U shape) is provided. A compression spring 9 is arranged between the housing rib 8 and the tripping lever 3. The end of the contact lever 2 is bent away in the form of an angle and has a cam 10 (shown dashed) on the reverse side. A locking element 11, which is formed by a protruding piece 12 of a bent-away part of the end (also shown dashed), is provided at the free end of the tripping lever 3. The wire-shaped tripping element 4 can be a thermally expanding metal wire, for example, or a wire of a memory alloy, as is known, for example, from CH-A-616270.

The above tripping device operates as follows:

1. If the tripping element is a thermally expanding wire, the wire is heated by an overcurrent or a part thereof and expands. The protruding piece 12 of the locking element 11 slides off the cam 10 and the contact lever 2 jumps upward due to the spring loading of the leaf spring 6: the contacts open.
2. If the tripping element is a wire of a memory alloy, the wire contracts with an overcurrent (or a part thereof) and the contact lever 2 is released again. The compression spring 9 in this arrangement is dimensioned in such a manner that a deformation of the wire 4 is given in the cold condition. For this purpose, it is desirable to provide a stop, not shown here, in the housing on the right of the tripping lever 3. However, the force of the compression spring 9 is weak enough for the contraction of the wire 4 on heating to be ensured.

In FIG. 2, a tripping device 1 with an intermediate lever 13 and an additional compression spring 14 is shown which is of weaker dimensions than the compression spring 9. The intermediate lever 13 is U-shaped and also rotatably supported with one leg in the linking piece 5. The shoulder of the intermediate lever 13 is elongated towards the bottom and pressed against a square stop 15 of the housing wall 7 under the spring force of the compression spring 9. The other leg of the intermediate lever 13 rests on the tripping lever 3. The additional compression spring 14 is arranged between the shoulder of the intermediate lever 13 and the tripping lever 3. To provide the greatest force transmission, the compression spring 14 is located close to the other leg of the intermediate lever 13. Naturally, it can also be installed in a different location.

This embodiment of the tripping device 1 is provided for wires of a memory alloy. In the case of overcurrent, the operation is the same as described above. If then the wire breaks due to careless handling of the circuit breaker - for example dropping -, the tripping lever 3 is pressed towards the right by means of the additional compression spring 14 and the contact lever 2 is released.

FIG. 3 shows another variant of the tripping device 1 with a transmission element 16 without additional compression spring (compare above). The transmission element 16 is also U-shaped but here rests on the tripping lever 3 under the pressure of the compression spring 9. One half of the shoulder of the transmission element 16 is elongated towards the bottom with a bent-away guide part 17 which, together with the adjacent leg of the transmission element 16, encircles a pin 18 in the housing wall 7. In the case of overcurrent—or the case of a short circuit—the transmission element 16 is integrally connected to the tripping lever 3. In this arrangement, the pin 18 is used as guide for the transmission element 16. In the case of a break of the wire 4 of a memory alloy, the pin 18 is then the pivot point for the transmission element 16 which rotates clockwise under the pressure of the compression spring 9 and presses the tripping lever 3 to the right. The contact lever 2 is thus released again.

FIG. 4 shows another variant of the transmission element 16 of the tripping device 1. For the sake of simplicity, the contact lever 2 has been omitted here. The transmission element 16 is essentially a rod-shaped plate, the top end 19 of which is bent away towards the right and rests in a wide opening 20 (shown dashed) of the tripping lever 3. This opening 20 prevents the transmission element 16 from slipping upwards (that is to say out of the plane of the drawing). The bottom end of the transmission element 16 is provided with a guide cam 21 which projects into the plane of the drawing and which is carried in a guide slot 22 in the housing wall 7. The guide slot 22 is closed on the right by means of a stop pin 23. The width of the guide cam 21 is much less than the width of the guide slot 22, as a result of which the guide cam 21 can be rotated to a limited extent in the guide slot 22.

The tripping device 1 operates as before. If then the wire 4 breaks, the transmission element 16 is rotated to the right around the stop pin 23 by the pressure of the compression spring 9, as a result of which the top end 19 also rotates the tripping lever 3 to the right and the circuit breaker is tripped.

I claim:

1. Tripping device for a circuit breaker having a housing and a switched-on position and a switched-off position, the tripping device comprising:

a wire-shaped tripping element having two opposite ends and a length between said ends, said length being thermally influenceable;

a tripping lever being under spring force and having a free end and another end, said other end being rotatably supported in said housing;

a contact lever being as well under spring force;

one of said ends of said tripping element being attached to said free end of said tripping lever, the other end of said ends of said tripping element being fixed in said housing;

a compression spring being arranged between a housing rib and said tripping lever, which always stretches said tripping element, on end of said tripping element being attached to said free end of said tripping lever;

said contact lever being latched in said switched-on position of said circuit breaker with said free end of said tripping lever; and said tripping lever and said contact lever being unlatched and said circuit breaker being switched from its switched-on to its switched-off position both with contraction and with expansion of said tripping element.

2. Tripping device for circuit breakers according to claim 1, characterized in that said tripping element is a thermally expanding wire or a fusible wire.

3. Tripping device for circuit breakers according to claim 1, characterized in that said tripping element is a wire of a memory alloy.

4. Tripping device for circuit breakers according to claim 3, characterized in that, between said compression spring and said tripping lever, a U-shaped intermediate lever is provided, one leg of which is supported close to said tripping lever and the other leg of which rests on said tripping lever, that a stop is provided in said housing, on which said intermediate lever is supported with an elongated part of its shoulder, and that an additional compression spring is arranged between said intermediate lever and said tripping lever.

5. Tripping device for circuit breakers according to claim 3, characterized in that, between said compression spring and said tripping lever, a transmission element is provided which is supported against said tripping lever and is carried on one side in the housing wall, and that a pin is provided which is normally used as stop and which provides the possibility of a rotational movement of said transmission element in the case of a break of said tripping element.

6. Tripping device for circuit breakers according to claim 5, characterized in that said transmission element is U-shaped and its shoulder is elongated with a bent-away guide part in the area of said pin.

7. Tripping device for a circuit breaker having a housing and a switched-on position and a switched-off position, the tripping device comprising:

a wire-shaped tripping element having two opposite end and a length between said ends, said length being thermally influenceable;

a tripping lever being under spring force and having a free end and another end, said other end being rotatably supported in said housing;

a contact lever being as well under spring force;

one of said ends of said tripping element being attached to said free end of said tripping lever, the other end of said ends of said tripping element being fixed in said housing;

said contact lever being latched in said switched-on position of said circuit breaker with said free end of said tripping lever; and said tripping lever and said contact lever being unlatched and said circuit breaker being switched from its switched-on to its switched-off position upon contraction of said tripping element, said tripping lever and said contact lever being unlatched and said circuit breaker being switched from its switched-on to its switched-off position upon expansion of said tripping element.

8. A tripping device for a circuit breaker having a switched-on condition and a switched-off condition, said tripping device comprising:

a housing;

a spring biased tripping lever rotatably supported in said housing;

a movable contact lever having a first position in latched engagement with said tripping lever and being biased to a second position out of latched engagement with said tripping lever;

means for latching said contact lever in said first position constituting said switched-on condition of said circuit breaker;

a wire-shaped tripping element having two opposite ends and a length between said ends, said length changing in response to temperature changes, one of said ends of said tripping element being attached to said tripping lever, the other end of said tripping element being fixed in said housing; and said tripping element upon expansion causing rotation of said tripping lever out of latched engagement with said contact lever to release said contact lever form said first position, said tripping element upon contraction causing rotation of said tripping lever out of latched engagement with said contact lever to release said contact lever from said first position.

9. A tripping device as defined in claim 8 wherein said tripping element is breakable to cause rotation of said tripping lever out of latched engagement with said contact lever.

* * * * *

UNITED STATES PATENT AND TRADEMARK OFFICE

CERTIFICATE OF CORRECTION

PATENT NO. : 4,973,931

DATED : November 27, 1990

INVENTOR(S) : Herbert Wirth

It is certified that error appears in the above-identified patent and that said Letters Patent is hereby corrected as shown below:

On the title page of the patent in [19], change "Herbert" to --Wirth--.

On the front page of the patent in [75], change "Wirth Herbert" to --Herbert Wirth--.

Column 4, Line 37, Claim 7, change "end" to --ends--.

Column 6, Line 2, Claim 8, change "form" to --from--.

Signed and Sealed this

Fifth Day of May, 1992

*Attest:*

DOUGLAS B. COMER

*Attesting Officer*

*Acting Commissioner of Patents and Trademarks*